US005720195A

United States Patent [19]

Ruple

[11] Patent Number: 5,720,195

[45] Date of Patent: Feb. 24, 1998

[54] LOWER FORMING ROLL REMOVAL AND REPLACEMENT STRUCTURE

[75] Inventor: Lewis H. Ruple, Perrysburg, Ohio

[73] Assignee: Abbey Etna Machine Company, Perrysburg, Ohio

[21] Appl. No.: 559,919

[22] Filed: Nov. 17, 1995

[51] Int. Cl.[6] ..... B21B 31/07; B21B 31/08

[52] U.S. Cl. ..... 72/238; 72/229

[58] Field of Search ..... 72/181, 182, 226, 72/238, 239

[56] References Cited

U.S. PATENT DOCUMENTS 5,450,740 9/1995 Lovinggood et al. ..... 72/239

*Primary Examiner*—Lowell A. Larson
*Assistant Examiner*—Rodney Butlar
*Attorney, Agent, or Firm*—Donald R. Fraser

[57] ABSTRACT

A tube forming machine having a pivotal mounted platform for receiving and holding the bearing block for the spindle of lower forming roll in the breakdown section which may be selectively indexed into supporting relation with the bearing block to eliminate the necessity of physically removing the bearing block from the roll stand assembly during the changeover from one lower forming roll to a forming roll of another size.

8 Claims, 2 Drawing Sheets

LOWER FORMING ROLL REMOVAL AND REPLACEMENT STRUCTURE

BACKGROUND OF THE INVENTION

1. Field of the Invention

The present invention pertains generally to a mill for the manufacture of continuous seam-welded tubes or pipes, and more particularly to a structure facilitating the rapid changing such a mill from the production of one size or shape of tube to production of tube of another and different size or shape.

2. Description of the Prior Art

In accordance with a well known process for producing seam-welded tubes, a continuous strip or skelp is advanced through forming apparatus comprising a series of forming rolls and progressively deformed into a tubular form having an open, longitudinally extending seam. The tubular form then advances through a welding station wherein the adjacent longitudinal edges of the tubular formed skelp are urged together and joined by a suitable welding process. The resultant welded tube may then have the raised weld bead removed from its surfaces and, after passing through a cooling zone, pass through a series of shaping and sizing rollers whereby it is formed to the final configuration and size. The advancing continuous tube is then severed by means of a travelling cutting unit into individual sections of a predetermined length.

The machines are designed to be capable of conversion to production of various sizes and cross-sectional configurations of tubes and pipes. As will be readily appreciated, such machines are massive precision machines representing a considerable capital investment. Heretofore in converting from production of tubing of one size or shape to another, the line was shut down and the various components were individually removed and replaced by components required for production of the next product. The replacement components then had to be properly set and adjusted on the line before production could resume. This entire changeover routine could consume a considerable period of time, typically five or six hours or more. The changeover thus involves a considerable expenditure in time and money, and an extensive loss of production. As a result, it becomes necessary to maintain unduly large inventories of finished products, contrary to the current trend toward maintaining minimum inventory and frequently switching from production of one product to another.

SUMMARY OF THE INVENTION

In accordance with the present invention the aforementioned deficiencies of the prior art devices are overcome by providing a tube mill utilizing an automated procedure for selection of roll assemblies of the mill to change from production of one tubular product to another. The roll assemblies of the mill which are changed during the changeover procedure are mounted in the break down section.

The above objectives may be achieved by a tube forming machine for the manufacture of metal tubing of varying sizes including at least one breakdown roll assembly, wherein the roll assembly includes:

1) stand means;
2) an upper forming roll member;
3) journal means for rotatingly mounting the upper forming roll member to the stand means;
4) a lower forming roll member;
5) a spindle for holding the lower forming roll member;
6) a removable journal member for rotatingly supporting the spindle on the stand means; and 7) platform means pivotally affixed to the stand means for selective movement of the formal member into and out of support for the spindle.

DETAILED DESCRIPTION OF THE PREFERRED EMBODIMENTS

Figure 1:
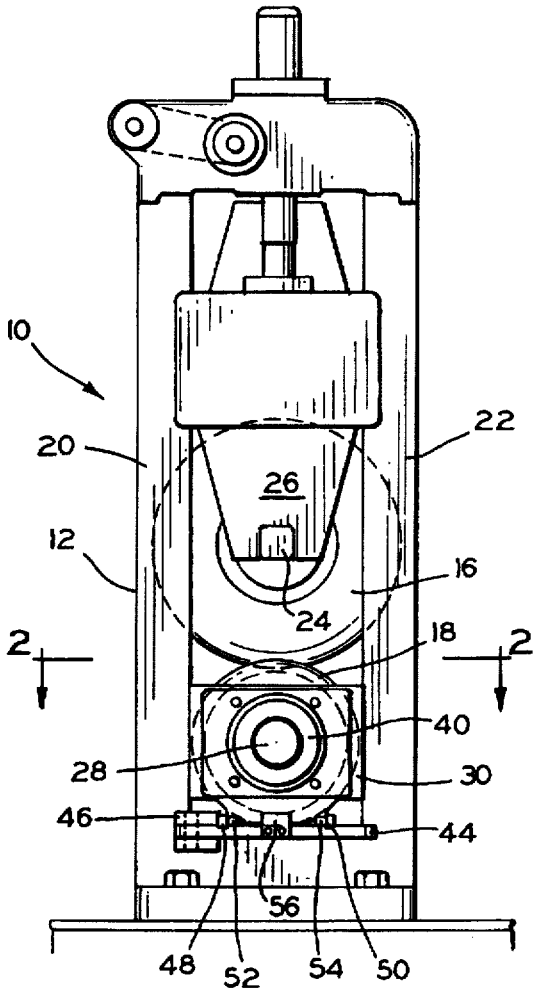
FIG. 1 is an elevational side view of a roll assembly of the breakdown section of a tube mill embodying the features of the invention.

Referring to the drawings, there is illustrated a breakdown roll stand 10 includes at least a pair of spaced apart side supports 12 and 14. The side supports are provided to adequately support a pair of cooperating forming rolls 16 and 18. It will be appreciated that the next adjacent roll stand includes at least a pair of cooperating forming rolls of a different contour than the rolls 16 and 18 to effect the gradual deformation of an initially flat strip into a tube. The particular and specific contour of the forming rolls of the breakdown roll stands is a function of the width and thickness of the strip being formed, the particular metal alloy of the strip, and the size of the ultimate tube being formed. It will be appreciated that the above parameters vary from one production run to another and, therefore, require corresponding changes in the make-up of the rolls of the breakdown roll stands. Heretofore, if the lower roll of the roll set of a stand required changing necessitating a rather time consuming dismantling the side support 12 of the roll stand 10 to provide access to the lower roll 18. Once the side support 12 was suitably dismantled, the roll 18 was manually manipulated by removing the same form to support spindle and transporting it to a remote storage area. Then a new forming roll was introduced into the roll stand. The roll stand was then reassembled in anticipation of the new production run. As an aside to the time consuming and difficult task of dismantling the roll stand to be changed, the manipulation of the forming roll requires a considerable degree of vulnerability toward physical mishap to the technicians assigned to the task. It must be understood that the forming rolls are extremely heavy, weighing several hundreds of pounds, are of a contour difficult to grasp, and typically covered with an oily and greasy lubricant applied to the rolls during the operation of the mill. All of these factors contribute to making the task of changing the forming rolls a very dangerous task wrought with possible physical harm.

The breakdown roll stand 10 and any subsequent such stands accomplish the initial forming operation to determine the final size of the completed tubing. When it is desired to produce another size tubing, the mill is typically shut down. The breakdown roll stands are thence disassembled permitting access to the lower rolls of the forming roll assembly. The lower rolls are removed and transported to a suitable storage area and replaced with a differently configured upper roll which is required to produce selected size tubing. Finally, the roll stand is reassembled, permitting the mill operation to commence production of the newly selected size tubing.

Amongst the problems encountered during the changeover procedure involves the manipulation of the bearing block assembly which journals the end of the spindle which supports the lower forming roll 18. Typically, the bearing block is extremely heavy and difficult to grasp and remove from the side support.

The present invention is effective to overcome certain of the problems and time consumption of the above discussed changeover procedure. More specifically, the breakdown roll stands are provided with a platform onto which the bearing block may be readily moved and then readily swung to a position clear of the supporting spindle to thereby provide access to the lower forming roll 18.

As clearly illustrated in the drawings, the side support 12 of the breakdown roll stand 10 includes a pair of upstanding spaced apart stanchions 20 and 22 each being suitably secured to the base of the mill. The lower forming roll 18 is mounted centrally between the stanchions 20,22 on a shaft or spindle 28, the opposite ends of which are journalled by suitable bearing blocks 30,32, respectively, supported by the side supports 12,14.

The roll stand 10 includes at least an upper roll 16 which is rotatingly mounted, in spaced relation from the lower forming roll 18, on a shaft 24. The opposite ends of the shaft 72 are journalled in bearing blocks 26, only a single one of which is illustrated in FIG. 1, which are mounted for reciprocal movement on the side supports. Reciprocal vertical movement is achieved by lead screw and drive mechanism which are simultaneously driven by a motor coupled to an interconnecting drive shaft.

The lower forming roll 18 is mounted on a shaft or spindle 28. The opposite ends of the spindle 28 are journalled in bearing blocks 30,32 mounted in the side supports 12,14, respectively. Tooling spacers 34 and 36 are employed to maintain the forming roll 18 centrally on the spindle 28 between the supporting bearing blocks 30,32. The end of the spindle 28 journalled in the bearing block 32 is typically coupled to a source of rotary motion through a universal joint, for example. The opposite end of the spindle 28 journalled in the bearing block 30 is maintained by a spacer 38 and nut 40 adapted to threadably engage external threads 42 formed on the end of the spindle 28.

A platform 44 is pivotally mounted to the side support 12 by a pivotal mounting bracket 46. The pivotal mounting bracket 46 enables the platform 44 to swing about a vertical axis to and from a position immediately beneath the outmost threaded end of the spindle 28.

The platform 44 is further provided with spaced apart parallel guide rails 48,50. The guide rails 48,50 direct the movement of the bearing block 30 during changeover as will be explained in detail hereinafter.

Figure 5:
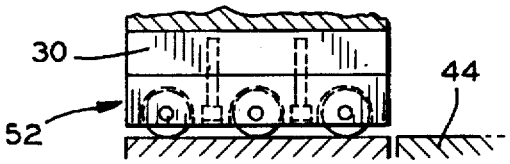
FIG. 5 is a sectional view taken along line 5—5 of FIG. 3.

The bearing block 30 is provided with spaced apart linear sets 52,54 of supporting wheels as illustrated in FIG. 5. The wheel sets 52,54 enable linear movement of the bearing block 30 onto and off of the platform 44.

Figure 4:
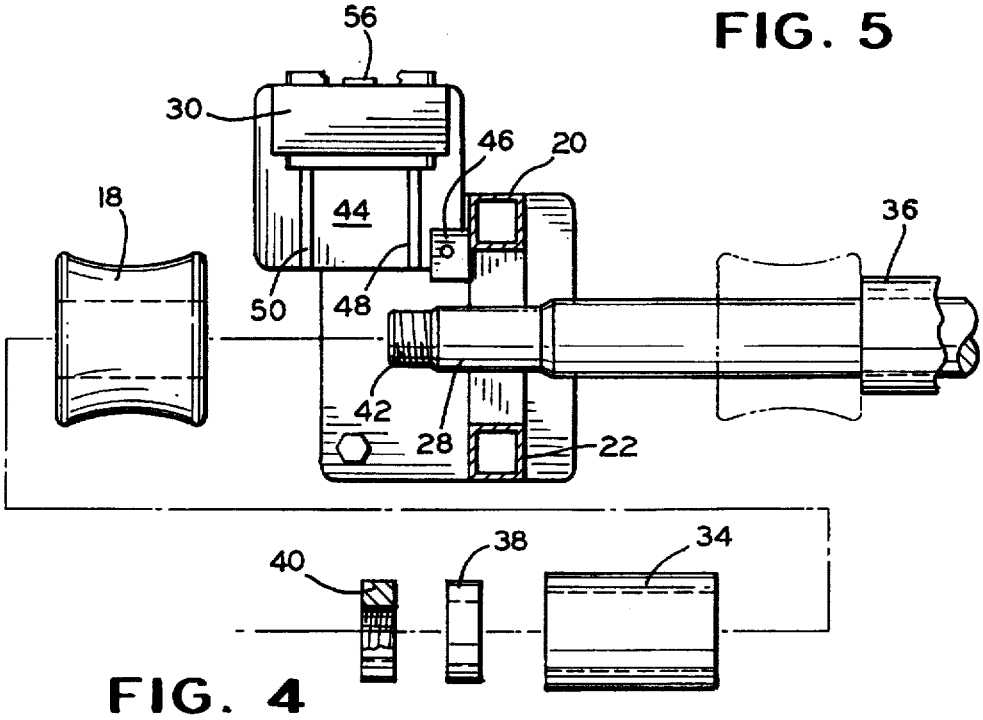
FIG. 4 is an exploded fragmentary, a view similar to FIG. 2 showing the lower forming roll removal from its supporting spindle.

In order to remove the lower forming roll 18 from the spindle 28, attention is directed particularly to the illustration of FIG. 4. Initially, the nut 40 is unthreaded from the threaded end 42 of the spindle 28. After the nut 40 is removed, the space 38 is likewise removed.

The bearing block 30 may now be grasped and moved outwardly from between the spaced apart stanchions 20,22, and thence wheeled onto the platform 44 as the wheel sets 52,54 are guided by the rails 48,50, respectively. A stop member 56 is mounted at the outboard edge of the platform 44 to limit the outer movement of the bearing block 30 on the platform 44.

Once the bearing block 30 has been moved against the stop member 56, the platform 44 is caused to be pivoted about the pivotal mounting bracket 46 to the full line position illustrated in FIG. 4. Thence the tooling spacer 34 is caused to be removed; followed by the removal of the forming roll 18. The forming roll 18 is transported to an off-line location, and a new forming roll 18 of the desired size and shape is afforded up to and positioned on the spindle 28 and the removal steps are reversed to secure the new roll in place of the spindle 28.

Figure 2:
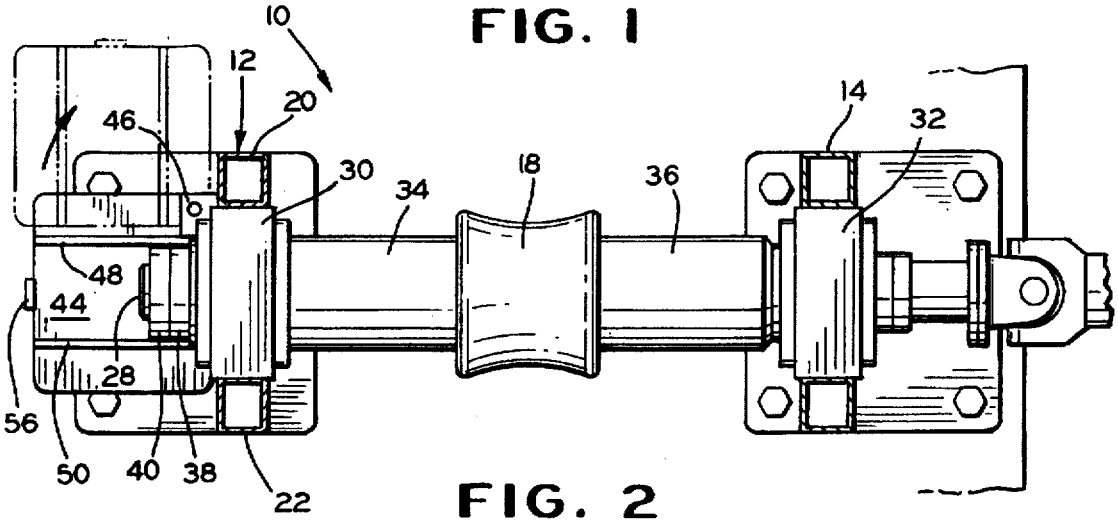
FIG. 2 is a sectional view of the invention taken along line 2—2 of FIG. 1.
Figure 3:
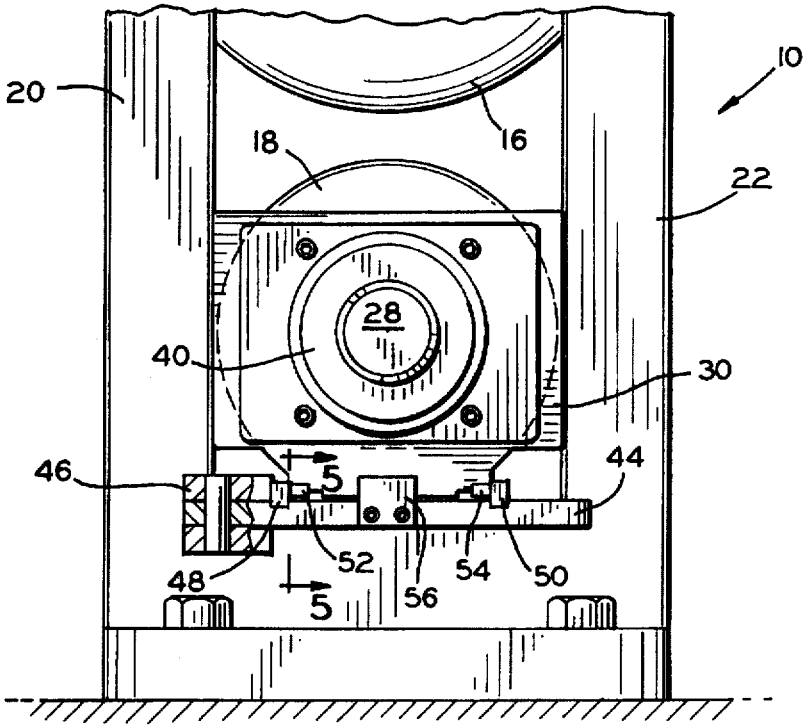
FIG. 3 is an enlarged fragmentary view partially in section of the lower roll assembly illustrated in FIGS. 2 and 3.

More specifically, after the new forming roll is properly positioned at the center portion of the spindle 28 and the tooling spacer 34 is fitted into place, the platform 44 carrying the bearing block 30 is pivoted from the position illustrated in FIG. 4 to the position illustrated in FIG. 2 and the bearing block 30 is wheeled into position between the stanchions 20 and 22. Then the spacer 38 is positioned over the end of the spindle 28 and the nut 40 is tightened.

It will be appreciated that the above described structure results in substantial savings in the changeover time and eliminates the necessity to manually manipulate the heavy and clumsy bearing block 30 during changeover procedures.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A tube forming machine for the manufacture of metal tubing of varying sizes including at least one breakdown roll assembly, said roll assembly including:

stationary stand means;

an upper forming roll member;

journal means for rotatingly mounting said upper forming roll member to said stand means;

a lower forming roll member;

a spindle for holding said lower forming roll member;

journal means including at least one removable journal member for rotatingly supporting said spindle on said stand means said journal member being selectively supported by said stand means; and a platform pivotally affixed relative to said stand means for supporting said journal member for selective movement of said journal member relative to said stand means into and out of support for said spindle.

2. A tube forming machine as defined in claim 1 wherein said platform includes spaced apart guide members for guiding movement of said journal member.

3. A tube forming machine as defined in claim 1 wherein said journal member is provided with depending wheels to facilitate movement of said journal on said platform.

4. A tube forming machine as defined in claim 1 wherein said stand means includes a pair of stand members disposed in spaced relation spanning said upper and lower forming roll members.

5. A tube forming machine as defined in claim 1 wherein said platform is connected to said stand means by a bracket pivotal about a vertical axis.

6. A tube forming machine as defined in claim 2 wherein said platform includes a stop member for limiting movement of said journal member.

7. A tube forming machine as defined in claim 4 wherein at least one of said stand members include a pair of upwardly extending spaced apart parallel stanchions.

8. A tube forming machine as defined in claim 7 wherein said removable journal member for rotatingly supporting said spindle for holding said lower forming roll is normally disposed between said spaced apart parallel stanchions.

* * * * *